US005696481A

United States Patent [19]

Pejas et al.

[11] Patent Number: 5,696,481

[45] Date of Patent: Dec. 9, 1997

[54] PROCESS FOR RECORDING INTERMEDIATE AND FINAL TIMES IN SPORTING EVENTS

[76] Inventors: Wolfram Pejas, Breubergstr. 14, 64354 Reinheim; Rolf Schäfer, Im Seesengrund 18, 64372 Ober-Ramstadt, both of Germany

[21] Appl. No.: 668,508

[22] Filed: Jul. 2, 1996

Related U.S. Application Data

[63] Continuation of Ser. No. 432,761, May 2, 1995, abandoned, which is a continuation of Ser. No. 244,698, filed as PCT/DE92/00960, Nov. 14, 1992 published as WO93/13500, Jul. 8, 1993 abandoned.

[30] Foreign Application Priority Data

Dec. 31, 1991 [GB] United Kingdom ..... 41 43 246.0

[51] Int. Cl.[6] ..... G08B 23/00

[52] U.S. Cl. ..... 340/323 R; 364/410; 368/3; 368/10

[58] Field of Search ..... 340/323 R, 309.15, 340/933, 539; 364/569, 410, 411; 368/2, 10, 113

[56] References Cited

U.S. PATENT DOCUMENTS

| | | | |
|---|---|---|---|
| 3,795,907 | 3/1974 | Edwards . | |
| 4,142,680 | 3/1979 | Oswald et al. | 340/323 R |
| 4,449,114 | 5/1984 | Fascenda et al. | 340/323 R |
| 4,517,563 | 5/1985 | Diamant | 340/825.54 |
| 4,857,886 | 8/1989 | Crews | 340/323 R |
| 5,140,307 | 8/1992 | Rebetez et al. | 340/323 R |
| 5,194,843 | 3/1993 | Jones et al. | 340/323 R |
| 5,367,286 | 11/1994 | Voillat | 340/323 R |
| 5,436,611 | 7/1995 | Arlinghaus, Jr. | 340/323 R |
| 5,511,045 | 4/1996 | Sasaki et al. | 340/323 R |

FOREIGN PATENT DOCUMENTS

| | | |
|---|---|---|
| 2914137 | 8/1980 | Germany . |
| 3929048 | 3/1991 | Germany . |
| 2-200280 | 8/1990 | Japan . |
| 8602186 | 4/1986 | WIPO . |

*Primary Examiner*—Brent A. Swarthout
*Attorney, Agent, or Firm*—Edwin D. Schindler

[57] ABSTRACT

To record times and intermediate times at sporting events, especially large and multi-discipline events, a method is proposed for immediately establishing the result, by which a large number of recording stations are positioned along the competition track which are connected to a central station, which evaluates the arriving information in a wireless or wire-bound manner, that every recording station has a frame antenna to absorb energy in the high-frequency range as well as to receive high-frequency signals and each athlete is handed a passive high-frequency transmitter with a personal code, which he holds in the recording station when the respective station is reached, whereby the recording station first re-charges the high-frequency transmitter via an antenna, afterwards the high-frequency transmitter passes the code to the recording station, the code is received by the recording station and is immediately passed with a further code from the recording station to the central station, where evaluation is carried out.

6 Claims, 1 Drawing Sheet

PROCESS FOR RECORDING INTERMEDIATE AND FINAL TIMES IN SPORTING EVENTS

This is a continuation of application Ser. No. 08/432,761, filed May 2, 1995, now abandoned, which is a continuation of application Ser. No. 08/244,698, filed as PCT/DE92/00960, Nov. 14, 1992 published as WO93/13500, Jul. 8, 1993, now abandoned.

BACKGROUND OF THE INVENTION

The invention concerns a method for recording times and intermediate times at sporting events, especially large and multi-discipline events with immediate establishment of the result.

At large sporting events with a large number of participants, which are generally known in the form of open cross-country races or marathons, participants are frequently sent onto the track at staggered intervals and in groups. For spectators this causes considerable problems resulting from the fact that the first person to cross the finishing line is not the fastest and thus the achiever of the best sporting performance, but is a different person. Consequently the attraction of watching is considerably diminished.

A further problem results from events which are assigned to the long-distance sports, running races, cross-country skiing races and similar, whether the participant crossing the finishing line has really covered the entire course and passed all the track control points or whether the participant—for whatever reason—has taken an unplanned short cut.

With multi-discipline sporting events, as is generally known, the winner is not established in the last discipline but by combining all the results. The winner of the long-distance running, which as a rule takes place at the end, is therefore not the winner of the multi-discipline event. Special difficulties result if the individual disciplines follow one another directly and, due to a lack of time, there is no opportunity for spectators and participants to use the intermediate results to determine and project how the time intervals and starting times of the individual participants should be in relation to one another to be able to immediately recognize the winner of the overall competition when the finishing line is crossed.

The attraction of such competitions for spectators and to a lesser extent for the participants diminishes if they are compared with those types of sports in which an immediate comparison and establishment of the current state of the competition is always possible both for spectators as well as participants. Short-distance races illustrate this point.

SUMMARY OF THE INVENTION

On this basis it is the object of this invention to create a method with the help of which it is possible to immediately establish intermediate times, to immediately evaluate and show the current state of the competition as well as to monitor the individual competitors on the course.

This object is achieved by this invention by positioning a large number of recording stations along the competition track, which are connected in a wireless or wire-bound manner to a central station which evaluates the arriving information, that every recording station has a frame antenna to absorb energy in the high-frequency range as well as to receive high-frequency signals and each athlete is handed a passive transmitter with personal code, which the athlete holds in the recording station when the respective recording station is reached, whereby the recording station first re-charges the high-frequency transmitter with energy via an antenna, afterwards the high-frequency transmitter passes the code to the recording station, the code is received by the recording station and is immediately passed with a further code from the recording station to the central station, where evaluation is carried out.

A central idea of this invention is essentially a system that is formed by a central station and several peripheral recording stations which transmit the received information to the central station either in a wireless or wire-bound manner. For those events which require a wide spatial distribution of recording stations preference will be given to wireless transmission to facilitate more rapid erection and dismantling and to avoid lengthy installation work.

Each recording station possesses an antenna, especially a frame antenna to emit electrical energy in the high-frequency range and at the same time a receiving station which accepts the code from the individual athlete—as explained in more detail below—and finally a transmission unit, which passes this information to the central station.

For its part, the central station has devices to receive the transmitted data and evaluates the data via a computer of the usual kind. To implement the method according to this invention it is also decisive that every athlete is handed a device which is assigned a personal code-number, the formation of which may vary within the scope of this invention, thus may consist of a combination of letters and/or numbers. This device is a passive high-frequency transmitter. Within the sense of this invention, the word "passive" means that the high-frequency transmitter does not have its own energy source; instead energy is transferred to it by the frame antenna. The result is that due to the lack of an energy supply the high-frequency transmitter can be kept to a minimum size and the lowest possible weight to rule out any burdening and hindrance of the athlete.

BRIEF DESCRIPTION OF THE DRAWING FIGURE

The single drawing FIGURE is a schematic illustration of the arrangement of a plurality of recording stations positioned along a running track, vis-a-vis a central receiving station, with athletes running along the track being provided with transmitters having an individual code, which allows the athlete to be identified by the various recording stations and the central station for evaluation.

DETAILED DESCRIPTION OF THE DRAWING FIGURE AND PREFERRED EMBODIMENTS

Figure 1:
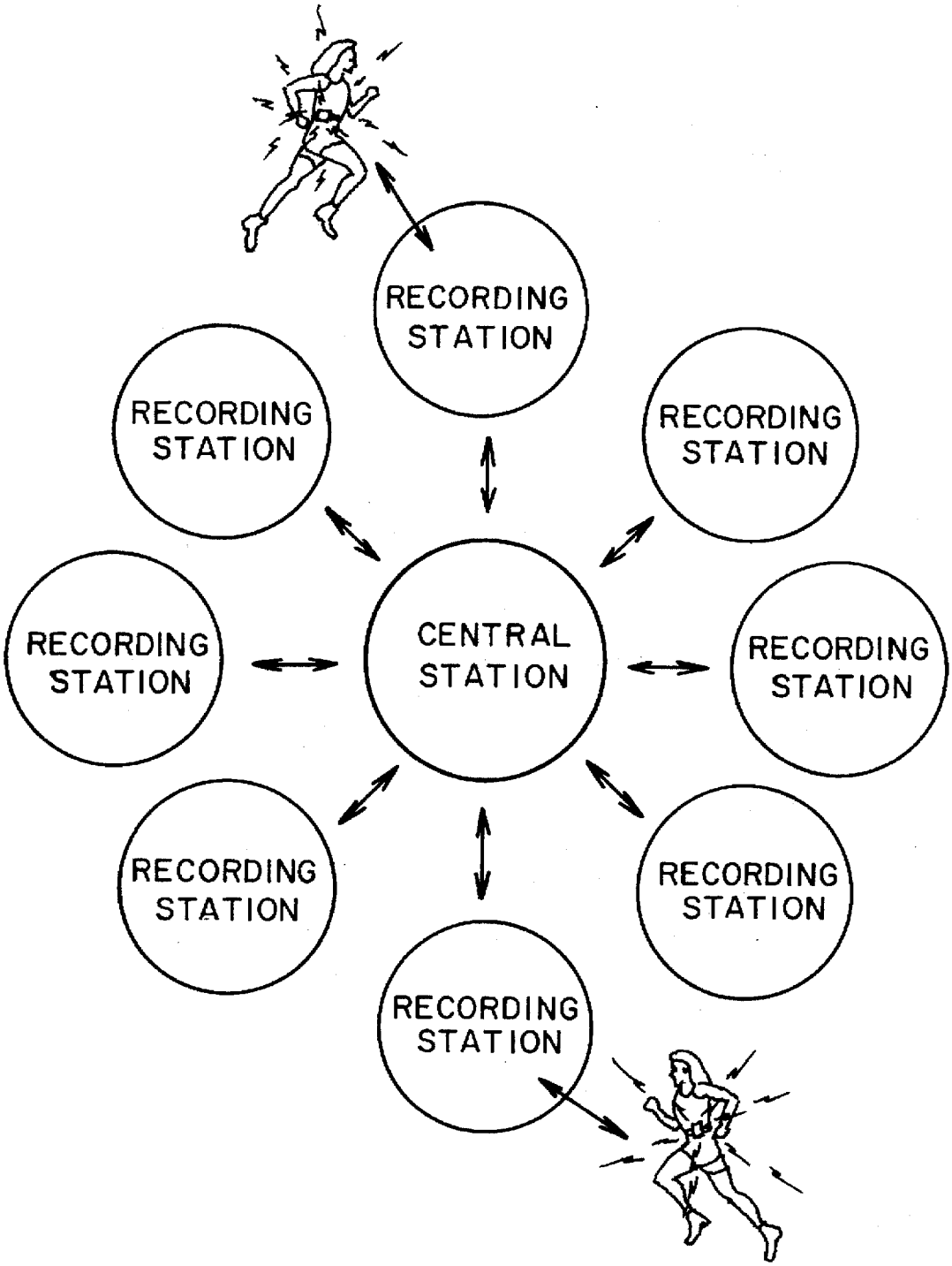

The method according to this invention is to be carried out as follows:

Each athlete receives one of the passive high-frequency transmitters with an individual code, which allows the individual athlete to be identified. The athletes make their way onto the course and head successively for the peripheral recording stations distributed over the entire course. Once arrived the high-frequency transmitter is held in the recording station, is re-charged for a short-time by the energy transmitted by the antenna and afterwards the individual code is transferred—also in a wireless manner—by the high-frequency transmitter to the recording station. From there the information, which is provided with a code for the recording station, is passed immediately to the central station and is recorded there. The information which practically arrives in real time at the central station indicates when a particular athlete ran to the concrete recording station. The present state of the competition can thus be determined and displayed for spectators.

Using the concrete example of a triathlon the advantage of this invention is explained as follows:

With the recording of the intermediate times it is possible to examine for the participant which of the different kinds of sports were finished successfully or not quite so successfully, how much time the athlete required for changing and how well the athlete performed compared with other competitors at every sub-stage, defined by the density of the recording stations.

The advantages achievable with the system according to this invention are decisive in several respects:

First, because of the possibility of establishing and thus indicating the present results, a transparency of the state of the competition is created for spectators, thus making the sporting experience more interesting. It is of special importance that preceding competitions can immediately be considered, so that the preliminary final result in the sense and according to the present state can be determined and indicated. In this way mass events can be organized attractively for spectators. The advantage for the organizer consists therein that course supervisors are no longer required, while monitoring is still possible: whether the recording stations installed along the course, in the sense of a course control, have really been passed. For the participant himself, it can be determined afterwards in which stages of the competition he performed especially well or badly compared with other competitors, so that it can be established where his strengths and weaknesses lie. A hindrance of the athlete to any extent ought to be ruled out by the small dimensions and the minimum weight of the passive high-frequency transmitter, which can be worn in the same way as a wristwatch.

The use of a digital code is preferred, because on the one hand it permits the direct evaluation of the signals, i.e. without the aid of a transformer, and furthermore allows a high number of individual codes, namely up to $2^{64}$.

In a typical embodiment of the method according to this invention it is planned to make the results obtained in the central station through evaluation transparent by displaying them on an indicator board, thus imparting them to spectators. In particular, the aforementioned passive high-frequency transmitter may be a transponder, distinguished by compactness, i.e. by small size and low weight.

We claim:

1. A method for recording racing times at sporting events, including large and multi-discipline events with intermediate determinations of racing results, comprising the steps of:

temporarily positioning a plurality of recording stations along a competition track, each of said plurality of recording stations being in communication with a central station, which includes means for evaluating information received from said plurality of recording stations;

providing each recording station with a recording station code specific to each of said recording stations; and, providing each sportsperson with a transmitter to be worn by the sportsperson, said transmitter having a personal code for each of said sportspersons, said transmitter being for transmitting signals from each of said sportspersons to said plurality of recording stations as said sportspersons pass near each of said recording stations, said transmitter sending said personal code of a respective sportsperson to one of said recording stations which, in turn, forwards said personal code to said central station for an evaluation of each of said respective sportsperson's performance, including recording intermediate racing times, wherein, said transmitter functions passively and with high frequency and said recording station charges said transmitter energetically via an antenna through high frequency before emitting said personal code, said plurality of recording stations being connected to said central station in a wireless manner and forwarding said personal codes, with said recording station code assigned to each of said recording stations, to said central station.

2. The method according to claim 1, wherein said personal codes of each of said sportspersons and said additional codes of each of said recording stations is effected digitally.

3. The method according to claim 1, wherein said evaluation of each of said respective sportsperson's performance is carried out via computer in said central station, said computer ranking in order of performance times of each of said sportsperson's performance.

4. The method according to claim 1, wherein said evaluation of each of said respective sportsperson's performance is displayed on an indicator board.

5. The method according to claim 1, wherein said transmitter, functioning passively and with high frequency, is a transponder.

6. The method according to claim 1, wherein said antenna is a frame antenna.

* * * * *